US005658089A

United States Patent [19]

Allen

[11] Patent Number: 5,658,089

[45] Date of Patent: *Aug. 19, 1997

[54] BUFFERED TROWEL GUARD CLEARANCE SYSTEM

[76] Inventor: J. Dewayne Allen, 403 Winchester, Paragould, Ark. 72450

[ * ] Notice: The term of this patent shall not extend beyond the expiration date of Pat. No. 5,480,257.

[21] Appl. No.: 576,011

[22] Filed: Dec. 21, 1995

Related U.S. Application Data

[63] Continuation-in-part of Ser. No. 170,512, Dec. 21, 1993, Pat. No. 5,480,257.

[51] Int. Cl.[6] ..... E01C 19/22

[52] U.S. Cl. ..... 404/112; 404/118; 293/126

[58] Field of Search ..... 404/102, 112, 404/118, 97; 451/353; 248/345.1; 293/102, 126, 127, 128, 142, 144, 149

[56] References Cited

U.S. PATENT DOCUMENTS

| | | | |
|---|---|---|---|
| 2,873,993 | 2/1959 | Savke | 293/127 X |
| 2,958,555 | 11/1960 | Johnson et al. | 293/127 X |
| 2,986,419 | 5/1961 | Barenyl | 293/127 X |
| 3,412,657 | 11/1968 | Colizza et al. | 404/112 |
| 4,027,991 | 6/1977 | Maass | 404/112 |
| 4,046,484 | 9/1977 | Holz, Sr. et al. | 404/112 |
| 4,055,362 | 10/1977 | Becker, III | 293/127 X |
| 5,096,753 | 3/1992 | McCue et al. | 293/126 X |
| 5,108,220 | 4/1992 | Allen et al. | 404/112 |
| 5,480,257 | 1/1996 | Allen | 404/112 |

*Primary Examiner*—James Lisehora

[57] ABSTRACT

A buffered guard clearance system for riding and manually pushed powered trowels adapted to allow finishing of a slab surface immediately adjacent an obstacle. The system comprises a movable wing displaceably coupled to the trowel guard cage and a buffer system mounted thereto. The wing is displaceable between a deployed position generally aligned with a lower ring of the cage and a retracted position. When retracted, an unguarded segment of the trowel rotor sweep is established that allows the finishing blades to be deployed immediately adjacent a wall or other obstacle. A displaceable coupling for moving the wing between the deployed position and the retracted position extends from the cage to the wing. The coupling comprises a sliding crossmember mounted on two spaced-apart brackets fixed to the cage. The crossmember supports the wing. The coupling may alternatively comprise electromechanical elements for displacing the wing between deployed and retracted positions. The buffer system contacts the wall to facilitate forward and rearward sliding movement of the trowel along the wall while finishing the slab immediately adjacent the wall. The preferred buffer system comprises a molding that snap-fits over the wing. The molding may be removed and replaced as necessary.

1 Claim, 4 Drawing Sheets

BUFFERED TROWEL GUARD CLEARANCE SYSTEM

CROSS-REFERENCED TO RELATED APPLICATION

This application is a continuation-in-part of a U.S. patent application filed on Dec. 21, 1993, Ser. No. 08/170,512, entitled Concrete Riding Trowel Guard Clearance System, and issued as U.S. Pat. No. 5,480,257, on Jan. 2, 1996.

BACKGROUND

I. Field of the Invention

The present invention relates generally to motorized concrete finishing machines. More particularly, the present invention relates to a guard clearance system for motorized trowels that will maintain the trowel in a spaced apart relationship with a wall (or other obstacle) while allowing finishing of a slab surface immediately adjacent the wall. Known self-propelled trowels are classified in United States Class 404, Subclass 112.

II. Description of the Prior Art

As will be recognized by those skilled in the art, it is well known that wet concrete must be appropriately finished. Motorized trowels are well known as machines for finishing wet concrete. Generally, motorized trowels come in two configurations, riding and manual walk-behind trowels. Each type of trowel employs finishing blades that rest directly on the concrete surface to be finished and that support the machine's entire weight. A wide variety of manually pushed troweling machines have previously been proposed. However, self-propelled riding trowels are preferred because they finish the concrete quicker and more efficiently. Motorized trowels generally employ pivoting blades. The trowel is passed over the concrete surface several times as the concrete sets. The pitch of the blades is adjusted for each pass.

Riding trowels generally include some form of frame from which two or more rotors downwardly project. Each rotor has three or four horizontally oriented, symmetrically disposed blades. The rotors are propelled by a self contained motor mounted on the frame that may be linked to rotor gear boxes. A yoke controlled bearing assembly is often employed to vary blade pitch. The weight of the trowel and the operator is transmitted frictionally to the concrete by the revolving blades. The operator sits on top of the frame and controls the movement of the trowel through a steering system. Steering is accomplished by tilting the blade assemblies to generate differential vector forces. The forces propel the frame across the concrete.

The present assignee, Allen Engineering, owns several prior motorized trowels and related improvements that may be considered relevant to the present invention. U.S. Pat. No. 4,577,993 issued on Mar. 25, 1986, discloses a power trowel with a cam actuated blade pitch adjustment mechanism. Another patent issued to Allen is U.S. Pat. No. 5,108,220 which is directed to a fast steering system for riding trowels. U.S. Des. Pat. No. D. 323,510 also discloses a riding trowel. The latter two patents each disclose, in detail, a guard system typical of those employed on riding trowels.

Riding trowels typical of those present in the art are disclosed in two patents issued to Holz, U.S. Pat. Nos. 4,046,484 and 3,936,212. '212 is a three rotor riding trowel while '484 is a more popular two rotor trowel. Each of the rotors in the Holz patents has three radially spaced apart blades. The blades are guarded by stationary outer rings and inwardly projecting frame members. In the '212 reference, inner rings are also employed to guard the blades.

Guard cages such as those disclosed in the above referenced patents are necessary to protect workers from the rotating blades and to protect the blades from striking rigid structures which could damage the blades. For example, it is more desirable for the cage to strike an obstruction, such as a column, than the blades. This prevents damage to the blades and the motor of the trowel. However, the use of such a guard cage makes finishing surfaces near obstructions and walls difficult.

Maass, U.S. Pat. No. 4,027,991, assigned to M-B-W, Inc., discloses a manually pushed power trowel with a rigid, relieved guard ring section. This section when retracted can slide along a wall during finishing operations to prevent contact between the blades and the wall. However, such a rigid section may "hang up" on a minor wall protrusions or imperfection. The rigid, retracted section could also easily damage the walls by scarring or discoloring it.

In the past, riding trowels failed to provide sufficient control to finish tight areas, such as a slab near the base of a wall. Therefore, it was unnecessary to provide a method for using riding trowels immediately adjacent walls or other structures. The advent of more easily controllable riding trowels, such as the trowel disclosed in aforementioned U.S. Pat. No. 5,108,220, renders the finishing of tight areas using a riding trowel more practical.

Hence, it is desirous to provide an improved guard clearance system for motorized riding trowels. Such a system would provide a portion of trowel guard that would move to a retracted position, exposing a segment of the finishing blade sweep. This exposed segment would then be maneuvered into close proximity with an obstacle, such as a column, curb or wall, to finish the concrete adjacent the obstacle. The displaceable coupling between the retractable portion of the guard and the trowel is either manually or electromechanically manipulated. The guard clearance system should also employ a buffer system to allow the trowel to contact a wall and move along the wall. Such a buffer system would facilitate finishing adjacent to the wall while still protecting the blades by preventing contact with the wall. An ideal buffer system would also work with a manually pushed power trowel.

SUMMARY OF THE INVENTION

My buffered guard clearance system for trowels protects the trowel blades while permitting the trowel to finish concrete surfaces immediately adjacent obstacles such as walls, beams, etc. The system may be used with either motorized riding trowels or manually pushed power trowels. A unique buffer permits the trowel to slide along the wall during finishing operations while maintaining adequate spacing between the blades and the wall.

The system uses a movable section or wing attached to the fixed guard cage of a trowel by a displaceable coupling. The coupling permits the wing to move between a deployed position and a retracted position.

When deployed, the wing is disposed on the end of the trowel at the base of the guard cage. In this position, the wing is aligned with the lowermost ring of the guard cage where it cooperatively protects the trowel blades.

When the wing is retracted, an unguarded segment of the blade's sweep is exposed. This unguarded segment may be deployed immediately adjacent an obstacle to facilitate finishing. Thus the operator can maneuver the trowel to position the unguarded segment near obstacles such as columns, curbs and walls.

The buffer maintains a preselected trowel-to-wall spacing during finishing. In the parent application, the buffer comprised a set of rotating wheels. The novel buffer disclosed herein comprises a replaceable molding. The molding fits around the retractable wing to protect the wall or other obstacle as trowel slides along it. The molding allows the trowel to slip along the wall while finishing the surface immediately adjacent the wall without harming it. The molding and the retracted wing maintain selected trowel spacing from the wall, thereby avoiding contact between either the trowel or the blades and the wall. The molding preferably snap-fits onto the wing so that it can be easily removed for replacement.

In one preferred embodiment, the displaceable coupling operates manually. However, the coupling may alternatively be a powered, electromechanical system remotely actuated by the operator. A manual and three different types of powered systems are disclosed in the parent patent. The different motive sources for the coupling are discussed in detail therein. Since the guard clearance system disclosed herein fits both the manual and the powered embodiments of the parent similarly, only the manual embodiment will be discussed in detail.

The manual coupling comprises an elongated, sliding crossmember that extends between two spaced-apart brackets. The brackets mount to the frame beneath a reinforcing header. Studs protrude upwardly from each bracket to pass through follower slots defined in the crossmember. Rotatable knobs may be tightened on the stubs to maintain selected crossmember placement. Adjustment of the wing is made by loosening the bolts and sliding the crossmember upwardly or downwardly along the slots.

The trowel must be stopped to retract or deploy the wing in the manual embodiment. The knobs are loosened and the wing then slides upwardly with the loosened bolts guiding the follower slots. The bolts are tightened to hold the wing in the retracted position. The trowel is then restarted and the concrete adjacent the obstacle is finished. If the obstacle permits, the buffer molding is utilized to allow the trowel to slide along the obstacle without the blades contacting the obstacle. To redeploy the wing, the trowel is stopped and the bolts are loosened. The wing then slides downwardly to align with the cage bottom and the knobs are tightened.

In the electromechanical embodiments, the trowel does not need to be stopped to adjust the wing and buffering system. Instead, they are adjusted as necessary though remote operator controlled switches. Therefore, the use of electromechanical devices to retract the wing and correspondingly adjust the buffer system would result in significant savings in both time and labor costs.

Thus, a fundamental object of the present invention is to provide a guard clearance system for powered trowels to facilitate concrete finishing immediately adjacent obstacles.

Another object of the present invention is to provide a clearance system that will maintain a powered trowel in a spaced apart relationship with a wall while finishing a slab.

A more specific object is to provide a clearance system for a multiple rotor riding trowels.

A related specific object is to provide a clearance system for a manually pushed power trowel.

Another object is to simplify concrete finishing operations by reducing required hand finishing.

A basic object is to provide an economical manual system in conformance with the present disclosure.

A further object is to provide a clearance system for both riding and power trowels of the character described that provides maximum safety while allowing finishing immediately adjacent obstacles.

A related object of the present invention is to provide a buffer system to prevent inadvertent contact between the blades of a trowel and a wall.

A related object of the present invention is to provide a buffer system with easily replaceable components.

Another basic object is to provide a greater degree of consistency in a finished slab surface by allowing a riding trowel to finish a greater portion of the concrete surface.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
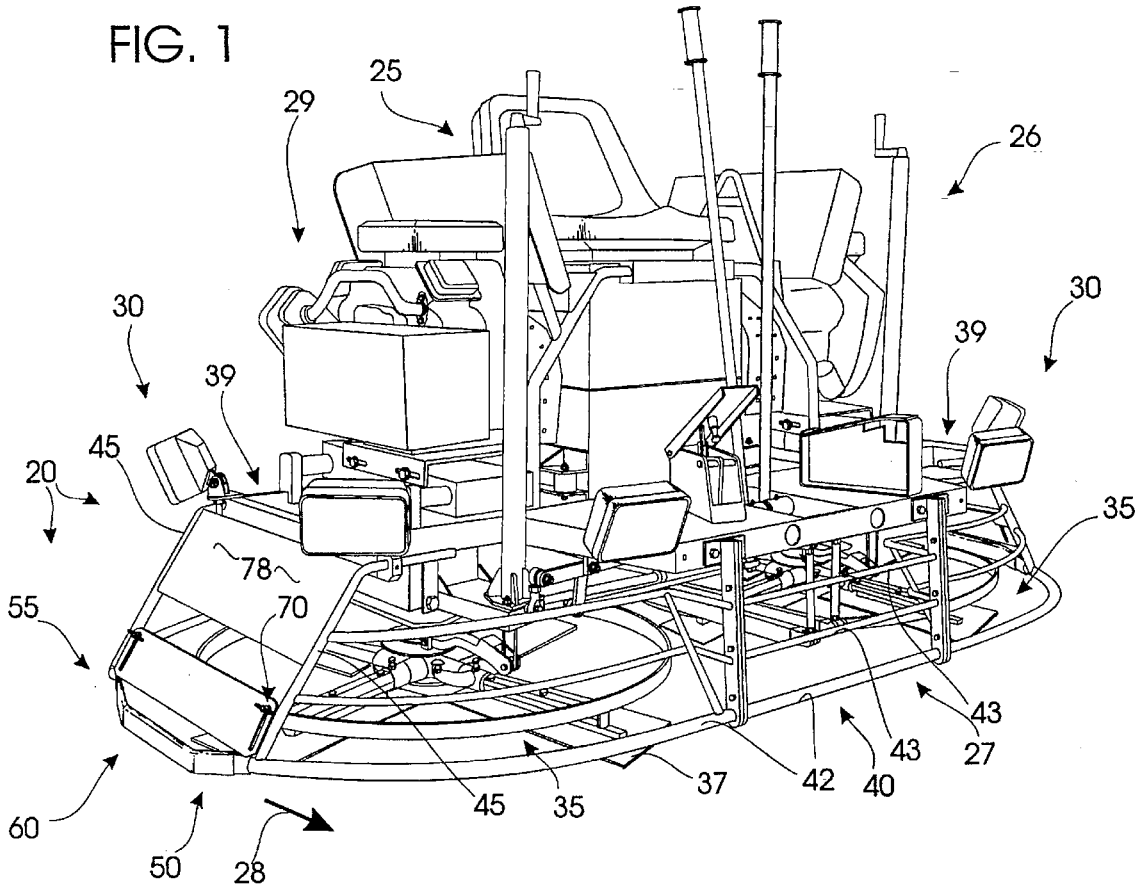
FIG. 1 is a front isometric view of a riding trowel mounting a manual embodiment of my guard clearance system, with the wing deployed.

Turning now to the drawings, the manual embodiment of my riding trowel guard clearance system is broadly designated by the reference numeral 20 in FIGS. 1 through 9. The guard clearance system is adapted to be used with either a riding trowel or a manual push trowel. Both types of powered trowels 25 (i.e., riding trowel 26 (FIG. 1) and manual push trowel 26A (FIG. 2)) have several common characteristics. Generally, each trowel 25 has a front 27 defined as the direction of travel 28 faced by an operator, an opposite rear 29 and spaced apart ends or sides 30.

However, there are some differences. For example, riding trowels 26 normally employ two or more rotors 35 that each have radially spaced apart concrete finishing blades 37. On the other hand, manual push trowels 26A generally employ only one rotor 35A with corresponding blades 37A. In both cases, the rotors 35, 35A are rotated at high speed to finish concrete, and the blade pitch may be varied depending on the cured condition of the concrete and the desired finish.

Both types of trowels 25 employ a guard cage 40 to prevent inadvertent contact between the rotor or blades and workers or obstacles. The cage 40 is generally secured to a frame 39 associated with the trowel 25. The cage 40 is comprised of at least one lower ring 42. Additional spaced apart upper rings 43 may also be included as cage size increases. Spokes 45 generally extend perpendicularly to the rings 42 and 43, providing rigidity to the cage. The guard cage 40 disposed about the riding trowel 25 is generally round or oval shaped. For example, the front 27 and rear 29 of the guard cage 40 of a riding trowel may be flat while the ends 30 are curved while manual power trowels front 27 and rear 29 are round and the ends 30 are flat.

Trowel structural details including frame construction, power train design, rotary blade suspension, motor control, steering linkages and the like are disclosed in U.S. Pat. Nos. 4,577,993, 5,108,220, 4,046,484 and 3,936,212. These patents are hereby incorporated by reference for purposes of disclosure. Also, as previously stated, this application is a continuation-in-part of a U.S. patent application filed on Dec. 21, 1993, Ser. No. 08/170,512, entitled Concrete Riding Trowel Guard Clearance System, and issued as U.S. Pat. No. 5,480,257, on Jan. 2, 1996, the teachings of which are again incorporated by reference.

Guard cages 40, such as those disclosed in the above referenced patents, are necessary to protect workers from the rotating blades 37, 37A. The cage also prevents the blades from striking rigid structures that could damage the blades. Normally, it is more desirable for the cage 40 to strike an obstruction, such as a column or wall, than the blades because the cage is usually easier and cheaper to repair. The cage thus prevents damage to the blades and the trowel motor. However, the use of a guard cage 40 makes finishing surfaces near obstructions and walls difficult.

My clearance system 20 allows a trowel 25 to finish a slab surface 44 immediately adjacent an obstacle such as a wall 46, column or curb. When used to finish a slab 44 adjacent a wall 46, the present clearance system 20 is adapted to maintain the trowel 25 in a spaced apart relationship with the wall 46 while allowing finishing of the slab 44 surface immediately adjacent the wall 46 (FIGS. 6 through 9). The system 20 is comprised of a movable wing 50 of trowel guard cage ring 42 coupled to the cage 40 or trowel frame 39 by a displaceable coupling 55.

Preferably, wing 50 comprises an elongated flat arc 52. Arc extends from cage ring end 42A to cage ring end 42B. Arc 52 comprises three flat strips 52A, 52B and 52C. The front strip 52A extends outwardly from the longitudinal axis of cage ring end 42A at approximately twenty-five degrees. Central strip 52B joins 52A at an obtuse angle and it is parallel to the axis of travel 28 of trowel 25. Rear strip 52C joins central strip 52B oppositely to front strip 52A. Rear strip 52C extends from central strip 52B to cage ring end 42B.

Figure 7:
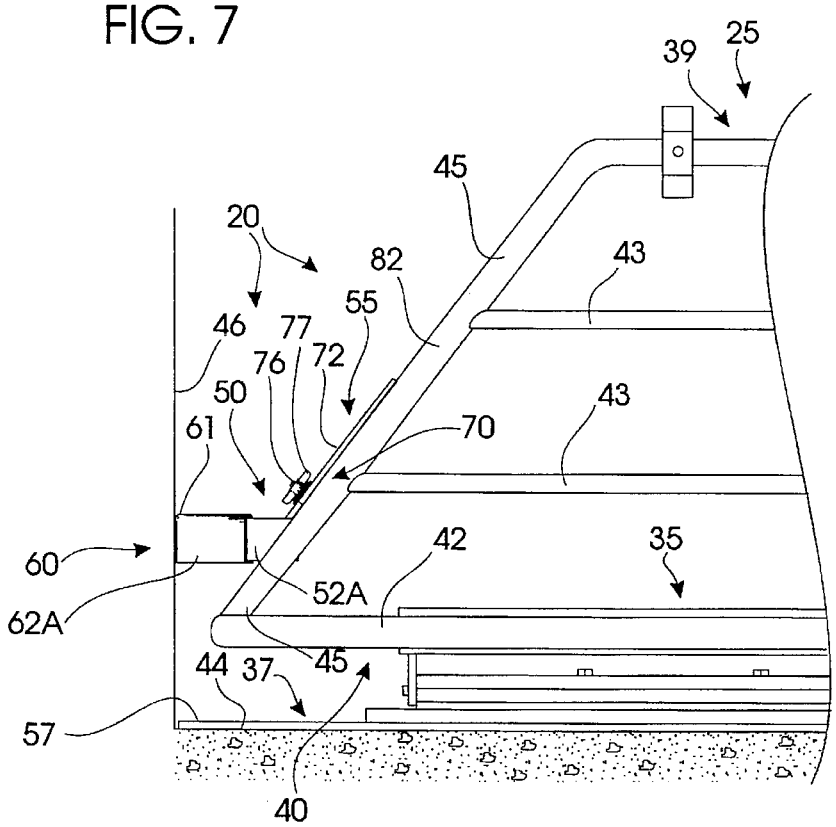
FIG. 7 is a fragmented, environmental front elevational view with the wing retracted and the buffer molding contacting a wall.
Figure 8:
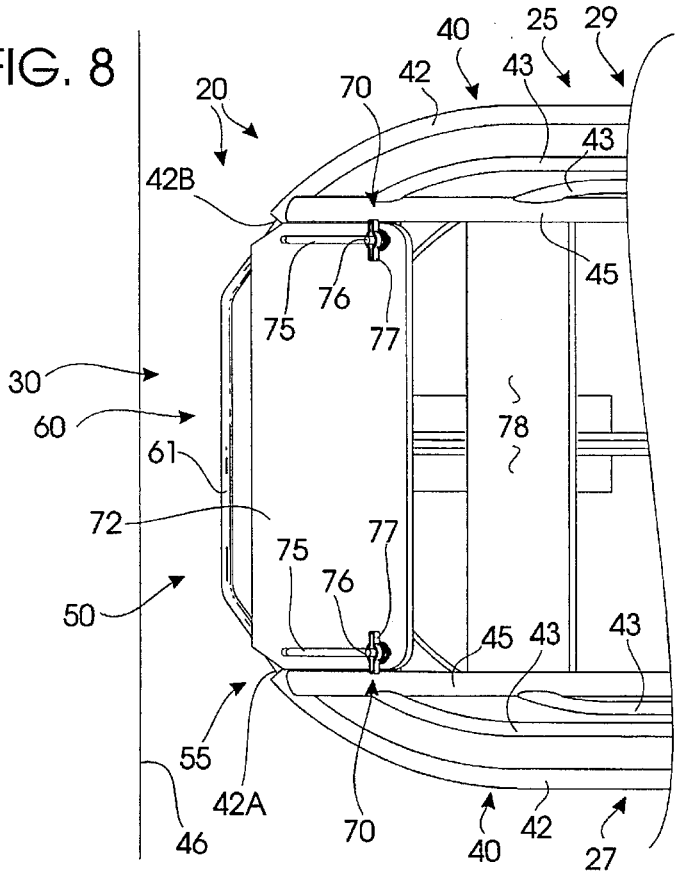
FIG. 8 is a fragmented, environmental top plan view with the wing deployed; and, FIG. 9 is a fragmented, environmental top plan view with the wing retracted and the buffer molding contacting a wall.
Figure 9:
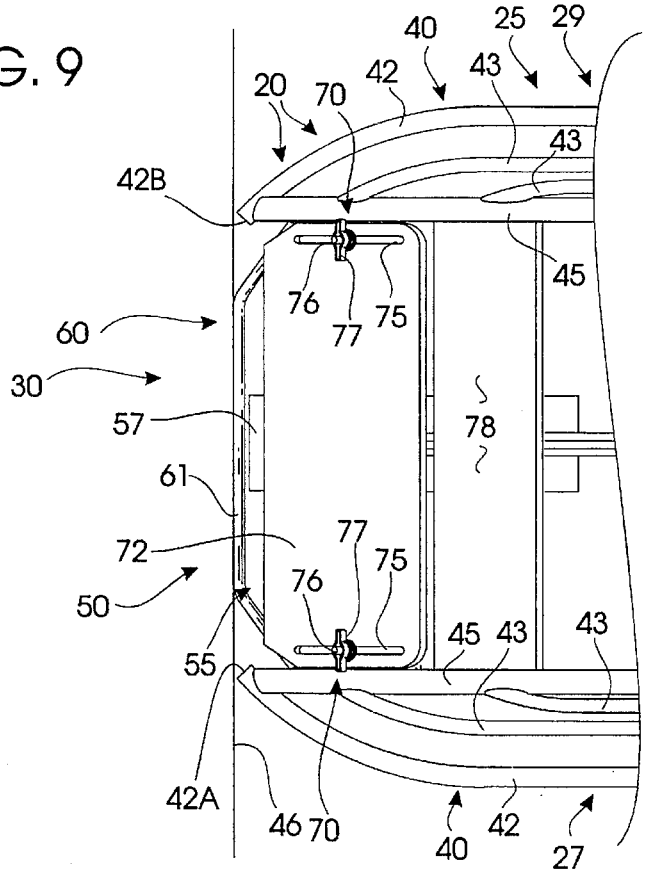

Wing 50 may be disposed in either a deployed position, adjacent lower ring 42 (FIGS. 1–3, 6 and 8) or in a retracted position (FIGS. 7 and 9). When deployed, wing 50 is aligned with the lower ring 42 and it extends between ends 42A, 42B. When wing 50 is retracted, an unguarded segment 57 of the rotor blades's sweep is exposed. This unguarded segment 57 may be deployed immediately adjacent an obstacle to facilitate finishing (FIG. 7). During such finishing, band 52 slides along wall 46 to protect segment 57. A buffering system 60 prevents band 52 from catching on the wall 46 and it also protects the wall 46 from chipping or discoloring.

Figure 3:
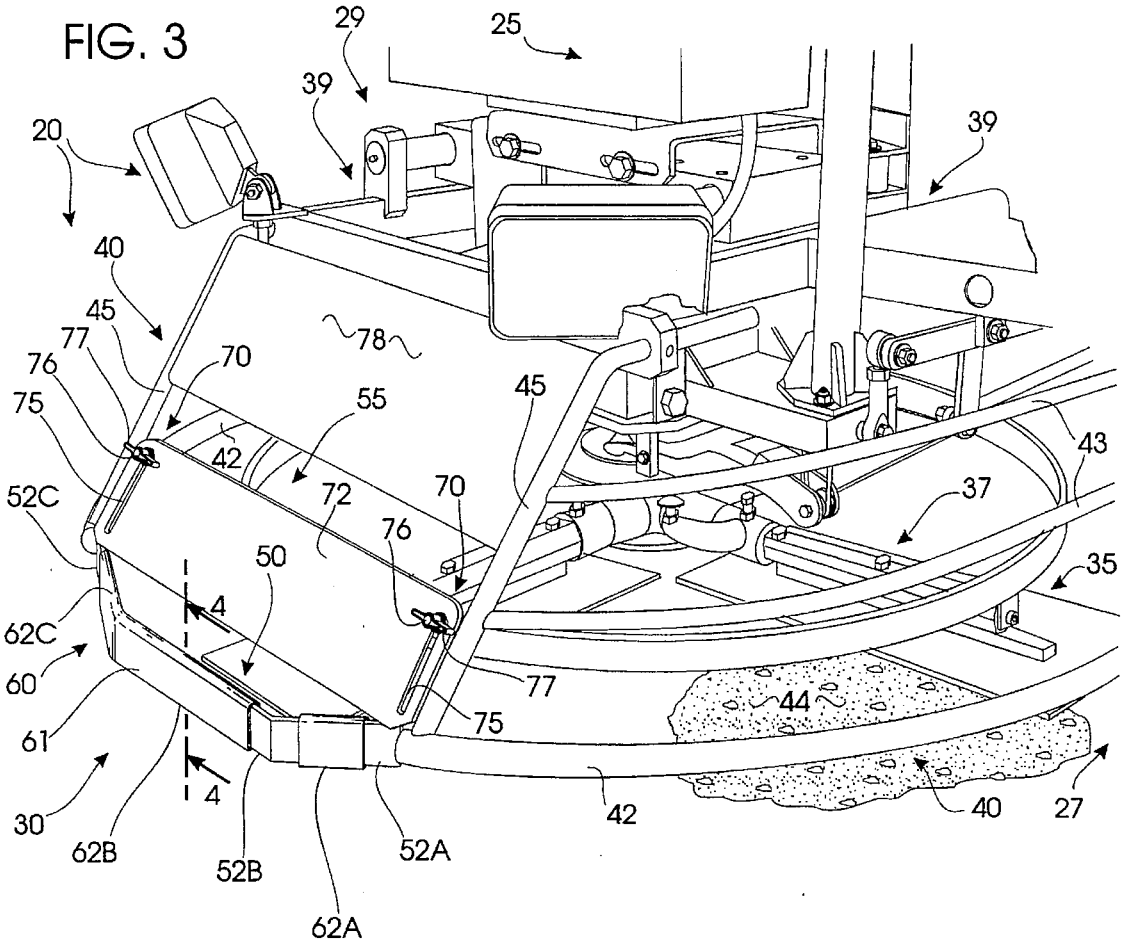
FIG. 3 is an enlarged, partially fragmented front isometric, environmental view of the riding trowel shown in FIG. 1, with portions omitted or broken away for clarity.
Figure 4:
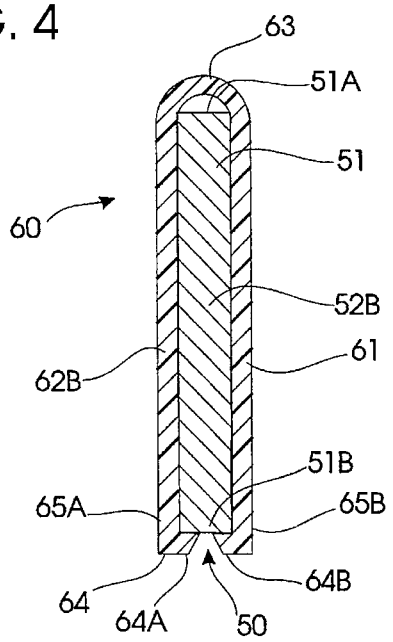
FIG. 4 is a cross-sectional view taken along line 4—4 of FIG. 3, showing the retractable wing and buffer molding.
Figure 5:
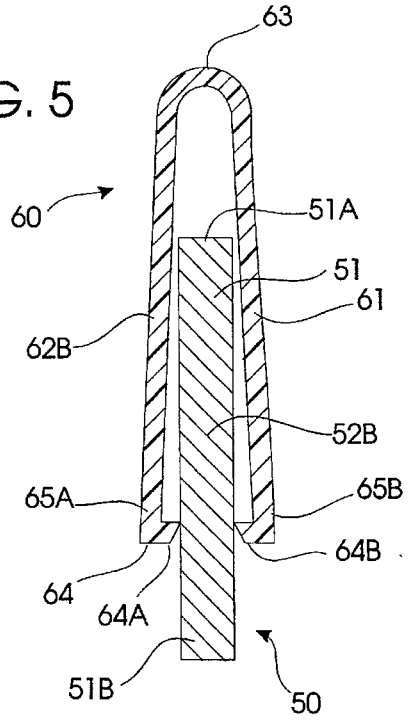
FIG. 5 is a cross-sectional view similar to FIG. 4, but showing the buffer molding in a moved position.
Figure 6:
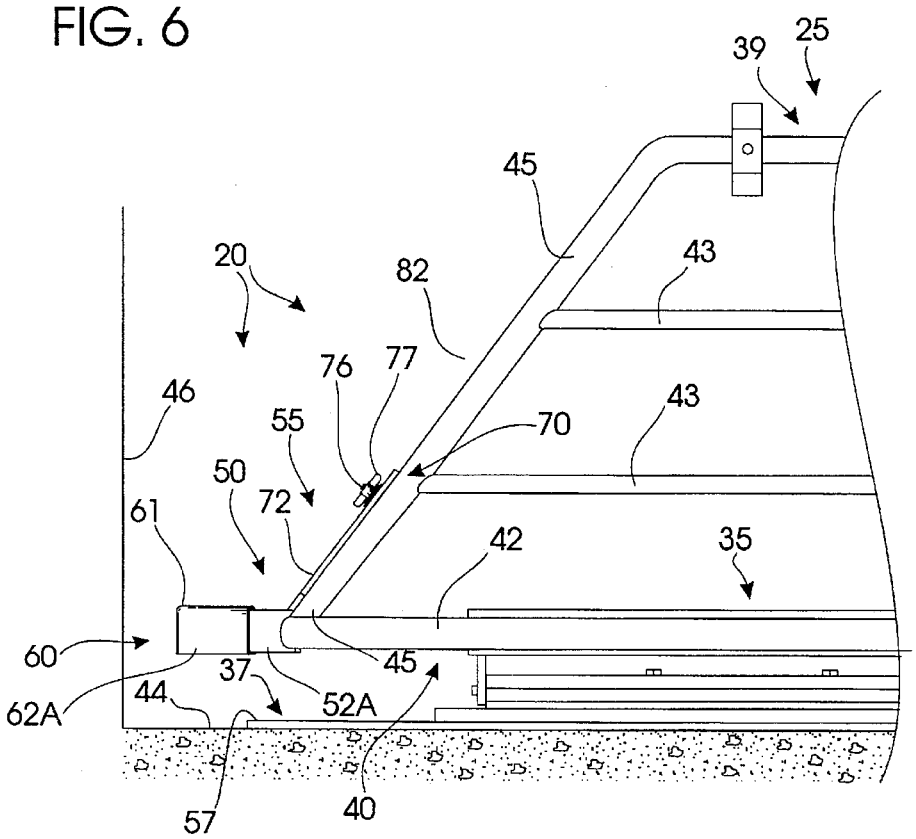
FIG. 6 is a fragmented, environmental front elevational view with the wing deployed.

In one preferred embodiment, buffer system 60 comprises a a hollow, elongated molding 61 (FIGS. 3–5). Buffer molding 61 mounts on wing 50. The molding 61 permits the trowel 25 to slide along the wall 46, insuring that the blades will not strike the wall 46 and be damaged. Preferably buffer molding 61 is molded from plastic or another similar material. Molding 61 comprises three shells 62A, 62B and 62C that cover respective arc strips 52A, 52B and 52C (FIGS. 3–5). preferably, molding 61 has a closed top 63 and an open bottom 64. Opposing tabs 64A, 64B protrude outwardly from respective sides 65A, 65B along bottom 64.

Molding 61 may be easily installed or removed from arc 51 as desired. Molding 61 is installed by first placing it upon the top of arc 51. Bottom 64 is aligned with arc top 51A and then pushed downwardly in the direction shown by arrow 66A (FIG. 5). When tabs 64A, 64B pass arc bottom 51B, they snap into a locking configuration (FIG. 4).

Removal of molding 61 from arc 51 proceeds similarly. First, tabs 64A, 64B are spread away from bottom 51B. Then molding 61 is moved upwardly in the direction shown by arrow 66B until it passes top 51A (FIG. 5).

Figure 2:
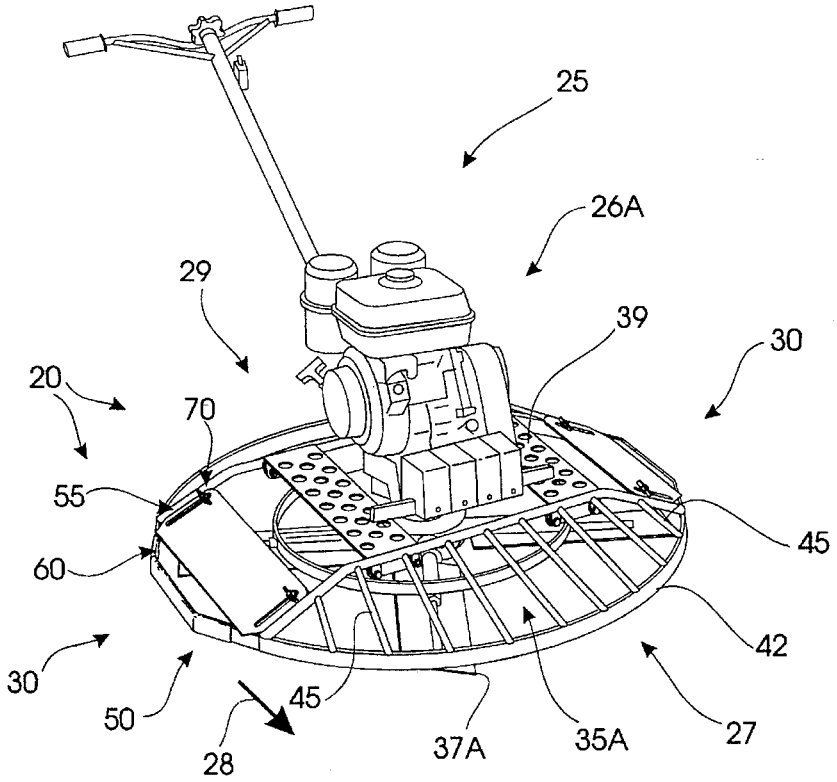
FIG. 2 is a front isometric view of a manual push power trowel mounting my guard clearance system with the wing deployed.

The adjustability of the coupling 55 allows the use of the present invention with varying widths of finishing rotor elements. For example, it might be desirous to place the present invention on an adjustable width riding trowel 26, as illustrated in FIG. 1. This type of trowel 26 may employ either concrete finishing blades 37 or concrete finishing pans fitted over blades 37. Alternatively, it might be desirous to place the present invention on a manual push power trowel 26A, as illustrated in FIG. 2. This type of trowel 26A generally employs smaller concrete finishing blades 37A and correspondingly smaller concrete finishing pans. Therefore, it is necessary that the displaceable coupling 55 be adjustable to facilitate the proper spacing with the wall 46.

The displaceable coupling 55 may be either manual or electromechanical. The preferred manual coupling 55 is shown in FIGS. 1 through 9. However, as discussed previously, alternative, powered couplings may be easily adapted to function with the invention disclosed herein.

The manual coupling 55 comprises a pair of spaced apart brackets 70. An elongated, flat crossmember 72 extends between brackets 70 to form coupling 55. Longitudinal, spaced-apart follower slots 75 are defined in each end of crossmember 72 adjacent brackets 70 respectively. The slots 75 are penetrated by threaded studs 76 protruding from brackets 70. The wing 50 is held in place by two studs 76 passing through the longitudinal slots 77. Each stud 76 extends outwardly from a respective bracket 70.

The studs 76 are each capped by a rotatable knob 77 that facilitates operator adjustment. Wing 50 is displaced by loosening knobs 77 and then sliding the wing 50 upwardly and inwardly, with the slots 75 following the studs 76. When adjusted properly, wing 50 is secured by tightening knobs 77 to maintain the wing in the retracted position (FIGS. 7 and 9).

Preferably, a reinforcing, cage header 78, having a generally rectangular shape, spans spokes 45. Header 78 provides additional stability for cage 40, allowing the use of a movable wing 50. Crossmember 72 also lends rigidity to both the wing 50 and coupling system 55.

Operation

In operation, system 20 is employed to finish concrete immediately adjacent an obstacle such as a wall 46, column, or curb. To finish the concrete immediately adjacent a column or curb, the wing 50 is retracted and the trowel 25 is moved as close as possible to the obstacle and then finishing is completed. Whenever a wall 46 is the obstacle, the buffer molding 60 slides across the wall, allowing finishing as close as possible to the wall 46 without damaging it or the finishing blades.

When the trowel 25 approaches a wall 46, wing 50 is retracted. In the preferred manual embodiment 20, the trowel 25 must be stopped and the knobs 77 loosened. The wing 50 then slides upwardly along the slots 75 in brackets 70 until a desired configuration is reached. Then, knobs 77 are tightened to secure wing 50 in place. The trowel 25 is then restarted and driven along the wall 46. Contact between the molding 61 and the wall 46 is maintained to properly finish the concrete along the base of the wall 46. To redeploy the wing 50, the trowel 25 is stopped and the knobs 77 are loosened. The wing 50 then slides downwardly until it is adjacent cage ring 42. Then, knobs 77 are tightened to maintain wing 50 placement.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A self propelled motorized riding trowel for finishing a concrete surface, said trowel comprising:

downwardly projecting rotary blade means for contacting and finishing concrete;

cage means surrounding said trowel for guarding said blade means, said cage means comprising:

arc means selectively displaceable between a deployed position mated to said cage means for guarding said blade means and a retracted position exposing at least a portion of said blade means;

coupling means comprising spaced-apart brackets and an elongated crossmember extending therebetween that cooperatively support said arc means for displacing said arc means between said deployed position and said retracted position, thereby establishing an unguarded cage segment allowing said finishing blades to be deployed immediately adjacent a wall; and, buffer means secured to said arc means between said brackets for contacting said wall and allowing movement of said trowel along said wall while finishing the surface immediately adjacent said wall, said buffer means comprising an easily replaceable resilient molding, said molding comprising a shell with a buffering exterior adapted to non-destructively slide over said wall, said shell having a pair of spaced-apart tabs that snap-fit onto the bottom of said arc means to temporarily couple said resilient molding to said arc means;

whereby said cage means maintains said trowel in a spaced apart relationship with said wall while the trowel finishes the concrete surface immediately proximate said wall.

* * * * *